US005471112A

United States Patent [19]

Hamon et al.

[11] Patent Number: 5,471,112

[45] Date of Patent: Nov. 28, 1995

[54] PLASMA PANEL WITH LOW-SCATTER SCREEN

[75] Inventors: Olivier Hamon, St Egreve; Andréas Oppenlander, Chilly Mazarin, both of France

[73] Assignee: Thomson Tubes Electroniques, Velizy, France

[21] Appl. No.: 77,545

[22] Filed: Jun. 17, 1993

[30] Foreign Application Priority Data

Jun. 19, 1992 [FR] France ..... 92 07481

[51] Int. Cl.[6] ..... H01J 1/62

[52] U.S. Cl. ..... 313/485

[58] Field of Search ..... 313/463, 467, 313/468, 479, 485, 486, 487, 496, 635; 345/60, 65, 72

[56] References Cited

U.S. PATENT DOCUMENTS 4,429,303 1/1984 Aboelfotoh ..... 345/72
4,692,662 9/1987 Wada et al. .

FOREIGN PATENT DOCUMENTS 0232941 8/1987 European Pat. Off. .
9014680 11/1990 WIPO .

OTHER PUBLICATIONS

Patent Abstracts of Japan, Hiroshi Sumoto, "Direct–Current Type Plasma Display Panel." Apr. 9, 1991, p. 1.

A Flat–Panel TV Display System in Monochrome and Color; Yoshifumi Amano; IEEE Transaction on Electron Devices, vol.–ED22; Jan. 1975; pp. 1–7.

Gas–Discharge Panels for Color TV Display; NHk Technical Monograph; No. 28; Mar. 1979.

*Primary Examiner*—Edward L. Coles, Sr.
*Assistant Examiner*—Jerome Grant, II
*Attorney, Agent, or Firm*—Oblon, Spivak, McClelland, Maier, & Neustadt

[57] ABSTRACT

It is sought to improve the image contrast of plasma panel type display screens. A plasma panel comprises a front plate (D1) bearing photoluminescent elements (LB1, LV1) constituted by grains (GL1, GLn) of luminophor material. According to one characteristic, the grains (GL1, GLn) have a diameter of less than 1.5 micrometer. This, in relation to the prior art, constitutes a substantial reduction of the diameter of the luminophor grains, which leads to reducing the coefficient of reflectance, the result of which is an improvement of the contrast of the image.

8 Claims, 2 Drawing Sheets

PLASMA PANEL WITH LOW-SCATTER SCREEN

BACKGROUND OF THE INVENTION

1. Field of the Invention

The invention relates to plasma panel type display screens. It relates more particularly to means for improving the contrast of the image displayed by these screens.

Plasma panels (or PPs) are flat screen display devices working on the principle of the discharge of light in a gas. PPs are used for the display of alphanumerical, graphic or other images, whether monochromatic or polychromatic.

There are different types of PPs, among which it is possible to distinguish those working in continuous mode and those working in alternating mode.

2. Description of the Prior Art

FIG. 1 shows a schematic, sectional view of a standard continuous type PP that can display polychromatic images.

The PP comprises two insulating plates D1, D2 which, between them, demarcate a space 3 filled with a gaseous mixture (the essential component of which is most usually neon). The plates are kept at a distance from each other by thickness shims and a seal (not shown).

According to a commonly used type of organization, each plate D1, D2 bears a network of parallel electrodes. The plates are oriented so that, between the two networks, the electrodes are crossed. Thus, for example, firstly the first plate D1 bears electrodes known as line electrodes Y1, Y2, Y3, Y4 that extend perpendicularly to the plane of the figure and that are seen along their section; to simplify FIG. 1, only four electrodes are shown, but it is usual to find a thousand or more electrodes per network. Furthermore, the second plate D2 bears the second network of electrodes, called "column electrodes" (represented by a single electrode X1) that extends in parallel to the plane of FIG. 1.

Each intersection of a line electrode with a column electrode defines a discharge cell, in such a way that, in the example of FIG. 1, only four cells C1 to C4 are shown, represented by a circle between dashed lines.

The principle of operation is the selective generation (i.e. generation at the level of selected cells) of electrical discharges in gas. Each discharge in gas is accompanied by an emission of light that is localized at each cell in which the electrical discharge is initiated. Each cell may thus constitute an elementary light source whose state (lit or extinguished) can be changed: a figure or a given shape is displayed by lighting up a sequence of cells whose location in the matrix corresponds to the shape of the figure to be displayed.

The color of the light produced by the discharge in the gas depends on the nature of the gas. However, it is common practice to add a light of a different color to this light, so that an observer (not shown) placed on the same side as the first plate D1, called the front plate", perceives a light having the desired color.

To this end, the standard practice is to incorporate one or more photoluminescent elements in the gaseous space 3, the function of these elements being that of converting an ultra-violet radiation, sent out by the discharge in the gas, into a visible radiation of a given color. It is common practice to coat the internal face 4 of the front plate with a homogeneous, photoluminescent layer made of a luminophor or material doped so as to emit at the desired color (in the case of a monochromatic image).

In the case of polychromatic images, the internal face 4 is provided with a succession of photoluminescent elements LB, LV, made of doped luminophors for the different colors which correspond to the so-called primary colors or basic colors used for television. The photoluminescent elements are each placed at the location of a discharge cell to which they give their color. These photoluminescent elements constitute patterns that succeed one another with a repetition that depends on the position assigned to each basic color in a polychromatic pixel PP1, PP2. The term "polychromatic pixel" must be understood to mean a set of discharge cells containing at least two colors.

In the example of FIG. 1, the polychromatic pixels PP1, PP2 are each formed in a standard way by means of four discharge cells:

the first pixel PP1 comprises the first and second cells C1, C2 in which there are respectively positioned a photoluminescent element or luminophor LB for the blue and a photoluminescent element LV for the green. This first pixel PP1 furthermore comprises two other cells (not shown) positioned behind the cells C1, C2 in a deeper plane than that of the figure, one of these cells containing a photoluminescent element for the red and the other cell containing a photoluminescent element for the green.

Similarly, the second polychromatic cell PP2 is formed, firstly, by the third and fourth discharge cells C3, C4 respectively containing a photoluminescent element LB for the blue and a photoluminescent element LV for the green and, secondly, by two other discharge cells in a deeper plane than that of the FIG. 1.

In the example shown in FIG. 1, it can be seen that the photoluminescent elements LB, LV are provided with an aperture 5 facing the line electrodes Y1 to Y4. These apertures 5 are designed to place the line electrodes in contact with the gaseous space in order to further the electrical discharge. It must be noted that these apertures 5 may be made only in the zone located between the surfaces facing the crossed electrodes X1 and Y1 to Y4.

With regard to the alternating type of PPs, they have a memory effect which notably enables the addressing of only the discharge cells for which the "lit" or "extinguished" state has to be extinguished. In panels of this type, the electrodes are covered with a layer of electrical material, and they are no longer in contact with the gas.

Certain alternating type PPs use only two crossed electrodes to define a cell, as described for example in the patent filed on behalf of THOMSON-CSF and published under No. 2 417 848.

There also exist known alternating type PPs, called "coplanar sustaining" electrodes, using three or more electrodes to form a cell. There also exist known alternating type PPs in which all the electrodes are borne by a same plate and are therefore located on a same side with respect to the gaseous space.

The advantage that all these PPs have in common as compared with cathode-ray tubes (or CRTs) is notably that of being highly compact and having flat screens.

However, the PPs having screens with one or more luminophors have the drawback, as compared with CRTs, of having a high coefficient of reflectance that generates an image with insufficient contrast when it is seen in a relatively luminous environment.

In FIG. 1, firstly an arrow EA pointed towards the front plate D1 symbolizes the incident ambient illumination on this front plate and, secondly, a second arrow Lr that emerges from the front plate D1 symbolizes the reflectance.

Finally, a third arrow Le symbolizes the intrinsic luminance of the screen (i.e. the luminance of the screen in conditions of zero ambient illumination).

A PP screen or a CRT screen (the latter too has a layer of luminophor material) constitutes, more or less, a scatterer of ambient illumination. Its contrast ratio C=Le/Lr (ratio of intrinsic luminance Le to the backscattered luminance Lr) is practically proportional to the ratio of its intrinsic luminance Le to its coefficient of reflectance r (Le/r).

In view of the similarities between the PP screens and the CRT screens as regards the layers of luminophors, these layers are made with similar technologies in these two types of screen. Consequently, to improve the contrast of the PPs, approaches similar to those of the CRTs are used.

In the case of the CRT, the luminous yield of the tube is sufficient to permit (at the cost of additional energy consumption) approaches that use filtering (neutral or colored), notably by using filters that act both on the intrinsic luminance Le and on the backscattered luminance, until this luminance is greatly reduced.

However, any filtering system induces a loss of luminance, requiring a reserve of light energy to preserve a sufficient dynamic range of luminance. The PPs do not have this reserve of luminous energy, because of their lower luminous yield.

However, trichromatic PP structures, provided with colored filters, are described in the article by TETSUO SAKAI, "A Gas-Discharge Color Panel for TV Display With Ultra-Low Reflectance" (NHK Laboratories Note Ser. No. 380, May 1990). It has been observed that despite notable improvement, the contrast remains far lower than that obtained with a CRT.

At present, in PPs, the layers of luminophor material, namely the photoluminescent elements LB, LV in the example of FIG. 1, are constituted by a thick powdery layer with a thickness E (of the order of 10 microns) that is slightly lower than in the CRTs.

The layer of luminophor material of the elements LB, LV is formed by several monolayers of almost spherical grains G1, G2, G3, . . . , Gn. (A "monolayer" is a layer which has a thickness containing only one grain and is formed by grains that come after one another in a plane substantially parallel to that of the support). The luminophor grains G1 to Gn generally have a mean diameter of the order of 4 micrometers, with a relatively major variation or dispersion of values of the diameter, possibly ranging from 1 micrometer to 30 micrometers.

The inventors have observed that this dispersion of the diameter values notably entails an anarchical positioning of the grains, the result of which is that it is necessary to have a substantial thickness (i.e. a thickness of several monolayers) to obtain a rate of covering that is sufficient to maintain appropriate luminous yield. (The greater the covering rate, the greater is the proportion picked up of ultra-violet radiation emitted by the discharge).

The inventors have also observed that when the thickness of the photoluminescent layer, and hence the number of grains, is increased, there is a tendency to increase the rate of covering (and hence the luminous yield) but that, unfortunately, the coefficient of reflectance r increases at the same time.

SUMMARY OF THE INVENTION

The invention relates to PPs of the type wherein the front plate (the plate located on the observer's side) has one or more luminophor materials. It is aimed at increasing the image contrast quality of such PPs in relatively luminous conditions of ambience, to achieve an image contrast quality similar to that of the CRTs, without reducing the luminous yield or the dynamic range of luminance.

To this end, the invention proposes the making of one or more photoluminescent layers by means of luminophor grains having diameters far smaller than those used in the prior art. This enables the making of one or more photoluminescent layers having, firstly, high transparency and, secondly, a high coverage rate with a low thickness.

With a PP, the very thick photoluminescent layer can be replaced by a layer of smaller thickness, because the exciting radiation located in the ultra-violet (chiefly between 150 nm and 200 nm) is absorbed in the luminophor layer at a very small depth with respect to the depth needed to absorb the electrons in the case of CRTs.

The invention therefore relates to a plasma panel comprising a front plate and a back plate between which a gaseous space is made, the front plate having at least one photoluminescent layer, wherein the photoluminescent layer is constituted by grains of luminophor materials having a diameter of less than 1.5 micrometer.

BRIEF DESCRIPTION OF THE DRAWINGS

The invention will be understood more clearly from the following description, given by way of a non-restrictive example, with reference to the appended drawings, of which.

MORE DETAILED DESCRIPTION

Figure 1:
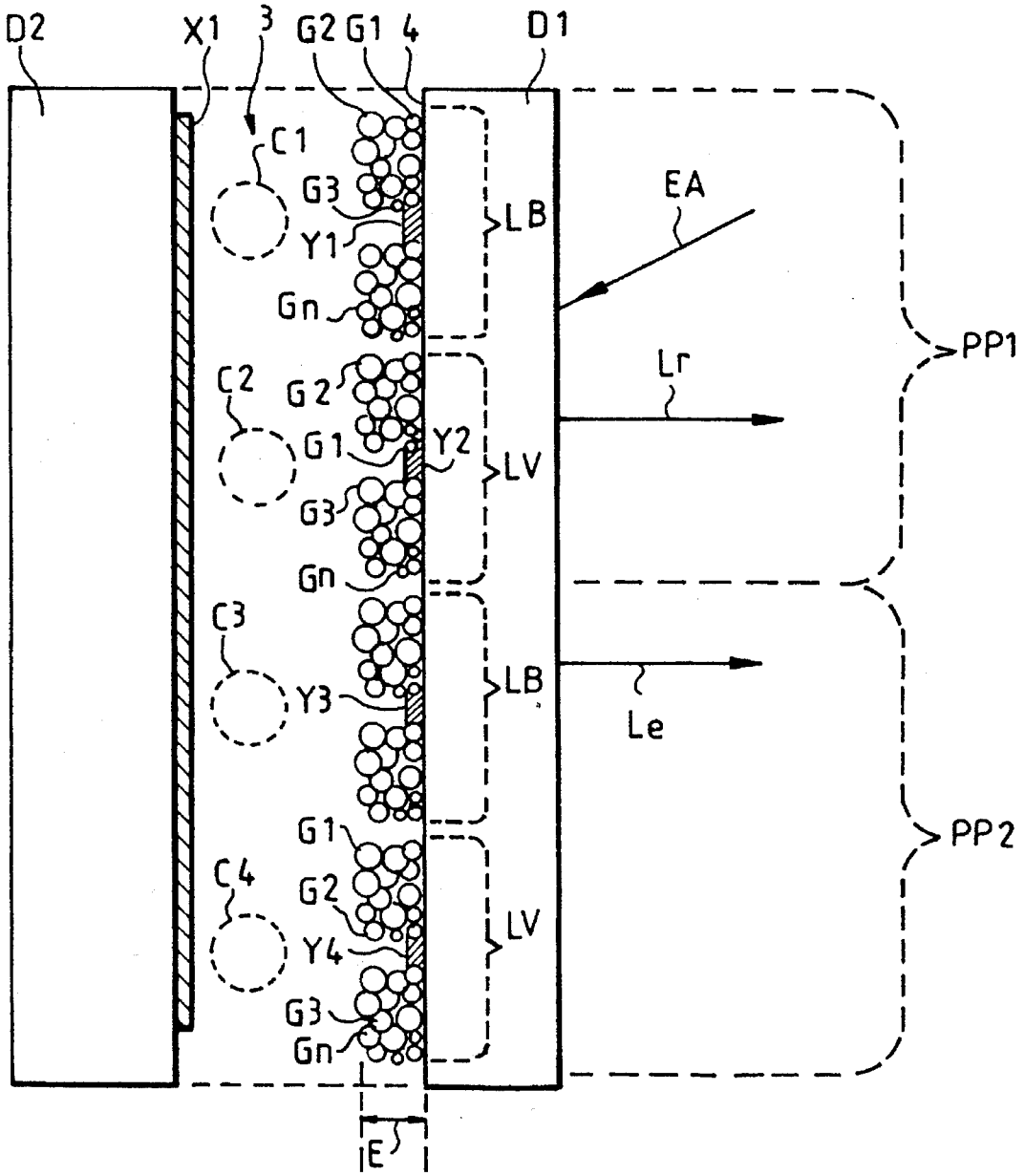
FIG. 1, already described, shows a prior art plasma panel.
Figure 2:
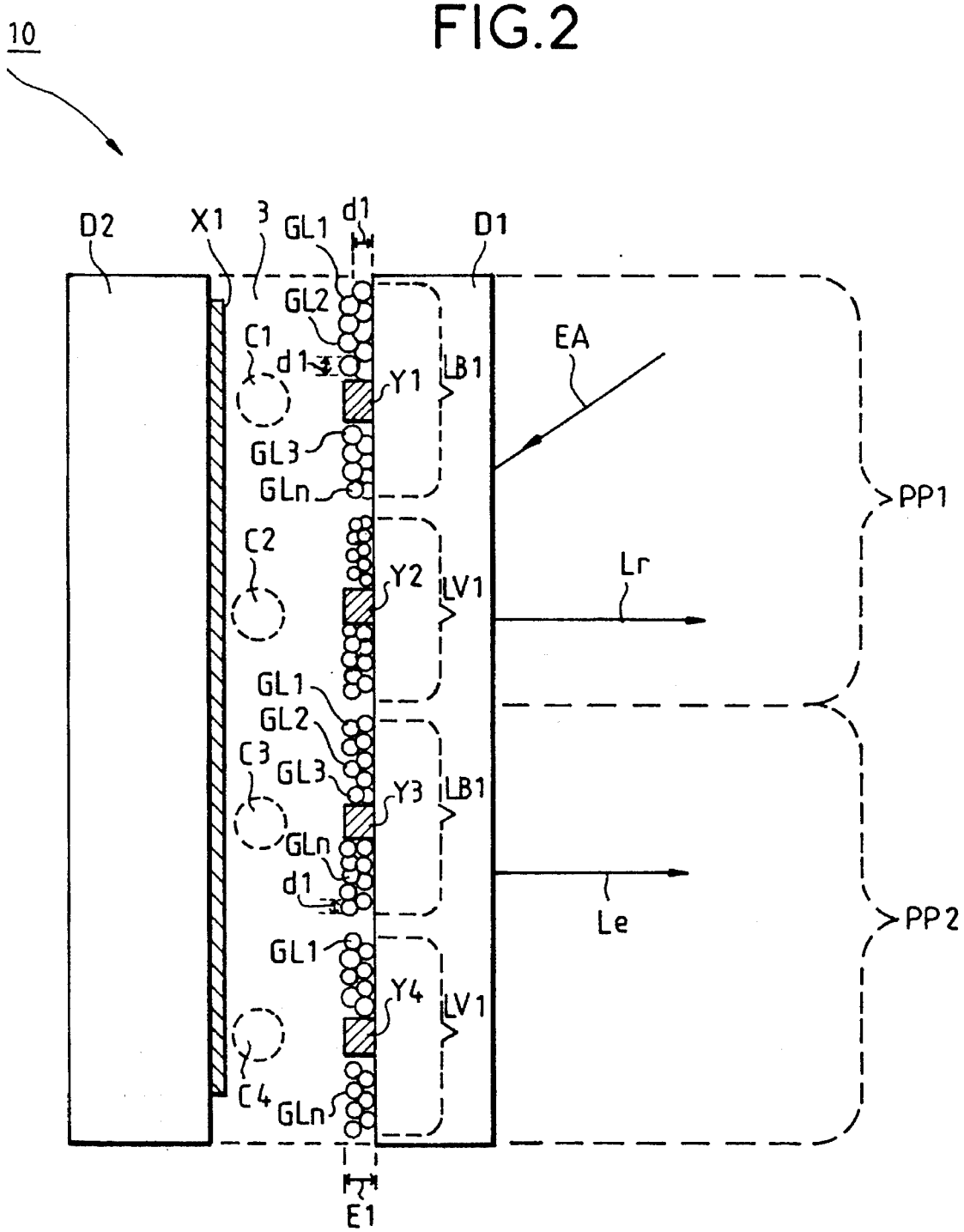
FIG. 2 shows a sectional view similar to that of FIG. 1, giving a schematic view of a plasma panel with a front plate bearing luminophor elements according to the invention.

FIG. 2 shows a plasma panel 10 or PP according to the invention. To simplify the description, the PP 10 is of a same type as the one shown in FIG. 1, i.e. of the DC type designed to display a trichromatic image. It comprises a front plate D1 and a back plate D2, between which a gaseous space 3 is made.

The front plate D1 bears a network of line or row electrodes whose representation is limited to four electrodes Y1 to Y4. The back plate D2 bears a network of column electrodes represented by a single column electrode X1; the column electrodes are orthogonal to the row electrodes Y1 to Y4.

Each intersection of a column electrode X1 with a row electrode Y1 to Y4 forms a discharge cell C1 to C4 to which there is assigned a photoluminescent element LB1, LV1, made of a luminophor material corresponding to a given color.

The photoluminescent elements LB1, LV1 are positioned on the internal face 4 of the front plate D1, with a same pitch as the pitch of the row and column electrodes Y1 to Y4, X1.

In the example shown, and as in the case of FIG. 1, the first and second discharge cells C1, C2 belong to a first polychromatic pixel PP1, and the third and fourth cells C3, C4 belong to a second polychromatic cell PP2.

The discharge cells C1 and C3 each comprise a luminophor element LB1 delivering a radiation centered on the blue, and the cells C2 and C4 each comprise a luminophor element LV1 delivering a radiation centered on the green. As in the example of FIG. 1, the polychromatic pixels PP1, PP2 are formed by four cells in such a way that each of them further comprises two other cells (not shown) located in a plane deeper than the plane of FIG. 2, one of which contains a luminophor element for the red and the other a luminophor element for the green.

According to one characteristic of the invention, the photoluminescent elements LB1, LV1 are constituted by luminophor grains GL1, GL2, GL3, . . . , GLn, the diameter d1 of which smaller than 1.5 micrometer. In particular, notably for a more efficient conversion of ultra-violet radiation into visible light by the luminophor grains GL1 to GLn, the mean diameter of these grains (in a same photoluminescent element) preferably but not obligatorily ranges from 0.05 micrometer to 0.5 micrometer. Grains GL1 to GLn form a photoluminescent layer LB1, LV1, and preferably (but not compulsorily) the photoluminescent layer has a thickness lower than 0.8 micrometer. It is furthermore recommended that the luminophor grains of a same photoluminescent element LB1, LV1 should have little dispersion in the value of their diameter, a dispersion for example of +25% of the mean diameter (i.e. a mean diameter of 1.2 micrometers in the case of a layer containing a grain with the largest diameter d1, namely 1.5 micrometer). According to a possible embodiment, 90% of the luminescent material grains GL1 to GLn, which constitute the photoluminescent layer LB1, LV1, have a diameter within plus or minus 25% of the medium grain diameter.

As compared with the prior art, the fact of forming the photoluminescent grains LB1, LV1 with grains of a far smaller diameter tends to reduce the coefficient of reflectance. For a same ambient illumination EA as in the prior art, the backscattered luminance Lr is far lower, with an intrinsic luminance Le that is unchanged or higher, resulting in a better contrast ratio C.

The whole process takes place as if each layer of luminophor grains GL1 to GLn had become more transparent and had allowed the ambient light to penetrate the gaseous space 3 more efficiently. It must be noted that this can partly be explained by the theory of MIE (see especially Born and Wolf, "Diffraction By A Conducting Sphere (Dielectric Sphere K →O); Theory of MIE" in Principles of Optics, Third Revised Edition 1964-1965, PERGAMON PRESS. The theory of MIE deals with the scattering of light by dielectric particles. It shows that spherical particles having a diameter of the order of one-third of the value of the incident mean wavelength (i.e. about 500 nm for white light, with particles having a diameter of 150 nm) scatter a thousand times less light than grains having a same shape and a diameter of about five micrometers.

Furthermore, the low dispersion in the values of the diameters of the grains GL1 to GLn makes it possible to obtain a high rate of coverage (which is essential for the luminous yield) with few monolayers of grains, so that the thickness E1 of the photoluminescent elements can remain low, which fosters an increase in the "front" luminance (the light emitted frontwards, i.e. towards the front plate D1 by the luminophor grains GL1 to GLn forming the elements LB1, LV1, in relation to the rear luminance which is the light emitted by these grains rearwards, i.e. towards the back plate). The front luminance is the luminance that comes out of the front plate D1 and therefore constitutes the intrinsic luminance Le when there are no means to reflect the rear luminance frontwards. The result of this therefore is an improvement in the contrast ratio.

In the case of the photoluminescent elements LB1, LV1 according to the invention, in view of the low dispersion of the values of the diameters, these elements may be constituted with few monolayers, two or three for example, i.e. the thickness E1 of the photoluminescent elements can have only two luminophor grains as in the example shown in FIG. 2. It is furthermore noted that, in this case, the thickness E1 of the photosensitive elements LB1, LV1 is not greater than that of the line electrodes Y1 to Y4, as can be seen in FIG. 2. In the case of the largest mean diameters, this may correspond to a thickness of the order of two micrometers, which is far below the thicknesses of luminophors in the prior art.

On the whole, it can be estimated that the invention provides a gain of ten in terms of ratio of contrast with respect to the prior art (C goes from 10 to 100 at 200 lux of ambient illumination).

In the example of the PP of the invention shown in FIG. 2, each discharge cell C1 to C4 is provided with a photoluminescent element LB1, LV1 having the shape of an islet or block made of luminophor material; the luminophor materials being different (or doped differently) according to the color to be assigned to to each cell C1 to C4. However, the invention can also be applied to the case where the internal face 4 of the front plate D1 is coated with a homogeneous and uninterrupted layer, i.e. one that emits in a same color for all the discharge cells.

The invention can also be applied in alternating type PPs with or without coplanar sustaining, and it can be applied both when the electrodes that constitute the cells are placed on each side of the gaseous space and when they are placed on a same side of this gaseous space.

The layers of luminophor materials used up till now in CRTs or PPs are thick layers, and the luminophor grains are most usually obtained under solid phase, from powders of oxide precursors; the grains obtained generally have diameters of over four micrometers.

The luminophor materials with very small grain size, designed to constitute one or more luminescent layers LB1, LV1 according to the invention, can advantageously be obtained by using a method called the Sol-Gel method, which is known per se, that consists in synthesizing grains by means of liquid precursors (generally alkoxides). This method is highly efficient for the making of very fine micrograins, the diameter of which is controlled by the pH of the solution.

The standard methods of coprecipitation in liquid phase may be used also to obtain fine grains having a controlled diameter. It must be noted that such methods make it necessary, however, to use techniques that are relatively delicate but well known such as: intense heating in a fluidized bed for Sol-Gel methods, heating in a controlled atmosphere in the case of coprecipitation in order to transform the gel or the amorphous precipitate into monocrystalline grains.

It has to be noted that a "Sol-Gel" method, that can be used to make fine luminescent films and is applicable notably in CRTs, is described in a European patent application published under No. 0 232 941 A2.

Either one of the above methods can easily be used to obtain luminophor grains with a diameter of 0.01 micrometer to 0.5 micrometer or even 1 micrometer or more, with a low dispersion of diameter values.

However, it is also possible to obtain luminophor grains such as these by other standard methods, for example by growth in gaseous phase.

Luminophor grains having the desired grain size can be deposited on the internal face 4 of the front plate D1 in different ways that are standard per se and that may possibly be similar to those used in the case of trichromatic CRTs or even in prior art PPs for example:

serigraphy;

spraying by spray gun;

the so-called spin-coating method, etc.

The making of island-shaped patterns in the luminophor layer can be accomplished by standard methods of microlithography.

What is claimed is:

1. A plasma panel display device comprising a front plate and a back plate between which a gaseous base is formed, said front plate having at least one photoluminescent layer which is constituted by grains of luminophor materials each having a diameter of less than 1.5 μm, a thickness of said at least one photoluminescent layer being approximately two to three times as great as said diameter of said grains of luminophor materials.

2. A plasma panel display device according to claim 1, wherein said photoluminescent layer is divided into separate photoluminescent elements, said plasma panel display device further comprising discharge cells, each corresponding to a different color.

3. A plasma panel display device according to claim 2, wherein said photoluminescent elements comprise at least two types of elements corresponding to different colors.

4. A plasma panel display device according to claim 2, wherein said photoluminescent elements comprise at least three types of elements corresponding to different colors to thereby form trichromatic images.

5. A plasma panel display device according to any of claims 1 through 4, wherein said photoluminescent layer has a thickness of less than 2 μm.

6. A plasma panel display device according to claim 5, wherein 90% of said grains of luminophor materials constituting said photoluminescent layer have a diameter in the range of ±25% of a mean diameter of said grains.

7. A plasma panel display device according to claim 5, wherein said photoluminescent layer is constituted by luminophor grains, each having a diameter ranging from 0.05 μm to 0.5 μm.

8. A plasma panel display device according to claim 5, wherein said photoluminescent layer has a thickness of less than 0.8 μm.

* * * * *